US007347620B2

(12) United States Patent
Omori et al.

(10) Patent No.: US 7,347,620 B2
(45) Date of Patent: Mar. 25, 2008

(54) WATCH EQUIPPED WITH CROWN LOCKING STRUCTURE

(75) Inventors: Nobukazu Omori, Chiba (JP); Haruki Hiranuma, Chiba (JP)

(73) Assignee: Seiko Instruments Inc. (JP)

( * ) Notice: Subject to any disclaimer, the term of this patent is extended or adjusted under 35 U.S.C. 154(b) by 113 days.

(21) Appl. No.: 11/360,949

(22) Filed: Feb. 23, 2006

(65) Prior Publication Data

US 2006/0193209 A1 Aug. 31, 2006

(30) Foreign Application Priority Data

Feb. 25, 2005 (JP) ..... 2005-051198

(51) Int. Cl.
*G04B 29/04* (2006.01)

(52) U.S. Cl. ..... 368/319; 368/288

(58) Field of Classification Search ..... 368/319, 368/288, 289, 308

See application file for complete search history.

(56) References Cited

U.S. PATENT DOCUMENTS 3,130,539 A * 4/1964 Davis ..... 368/289
5,663,934 A * 9/1997 Wenger et al. ..... 368/319
7,111,977 B2 * 9/2006 Hiranuma et al. ..... 368/289
2004/0071049 A1 4/2004 Hiranuma et al.

FOREIGN PATENT DOCUMENTS

JP 5-119162 * 5/1993 ..... 368/288

* cited by examiner

*Primary Examiner*—Renee Luebke
(74) *Attorney, Agent, or Firm*—Adams & Wilks

(57) ABSTRACT

A watch has a crown threadedly locked to a stem pipe mounted to a barrel. The barrel has a pipe installation hole and a threaded hole that extends perpendicular to and in communication with the pipe installation hole. The stem pipe has an insertion portion and a barrel outside protruding portion. The insertion portion is inserted in the pipe installation hole such that the insertion portion can be withdrawn from outside the barrel. The barrel outside protruding portion is disposed outside the barrel and has an external thread to which the crown is removably threaded. An engaging recessed portion is formed in the outer surface of the insertion portion. An annular waterproof packing is sandwiched between the pipe installation hole and the insertion portion. A mounting screw is threaded into the threaded hole so as to be removable back and forth. A front-end portion of the mounting screw is inserted in the engaging recessed portion to hold the stem pipe to the barrel.

4 Claims, 7 Drawing Sheets

WATCH EQUIPPED WITH CROWN LOCKING STRUCTURE

BACKGROUND OF THE INVENTION

1. Field of the Invention

The present invention relates to a watch equipped with a structure for holding the crown to prevent it from being inadvertently rotated.

2. Description of the Prior Art

In some of watches such as wristwatches, the crown is locked by making use of threaded engagement to prevent inadvertent rotation of the crown during carriage (the structure or function is referred to as threadedly locking, threadedly locking structure, or threadedly locking function in the present specification).

In the threadedly locking structure, a stem pipe is mounted to a barrel in which a watch movement is incorporated. The internal thread of the crown which is fitted over a barrel outside protruding portion is threadedly engaged to an external thread formed on the outer surface of the barrel outside protruding portion of this pipe. In this way, during normal times, the crown is threadedly engaged to the outer surface of the barrel outside protruding portion of the stem pipe such that the crown strikes the barrel outer surface of the barrel. In this way, threadedly locking is achieved, preventing inadvertent rotation of the crown. Also, when the watch movement is manipulated, the crown is threadedly disengaged from the external thread and then the crown is pulled and moved. Under this condition, the stem located inside the stem pipe can be rotationally manipulated via the crown.

In the prior art watch equipped with such threadedly locking structure, the stem pipe mounting portion is generally water-proofed by brazing the stem pipe to the barrel (see, for example, JP-A-57-46181).

Besides, another watch having a stem pipe mounting portion that is water-proofed is also known (see, for example, JP-A-2004-245594). In particular, an external thread different from the external thread to which the crown is threadedly engaged is mounted to the stem pipe. This different external thread is threaded into a pipe installation hole in the barrel. As this threaded insertion is performed, waterproof packing is sandwiched between the barrel and the stem pipe along the direction in which the center axis of the stem pipe extends.

In the watch equipped with the threadedly locking structure, as the crown is repeatedly rotationally manipulated, the internal thread of the crown and the external thread of the stem pipe which are threaded together may wear down or scrape off each other. Consequently, the function of the threadedly locking structure deteriorates.

Where such a circumstance is encountered, parts which are located around the crown and which involve removal of the stem pipe from the barrel cannot be replaced in the watch of JP-A-57-46181 where the stem pipe is brazed to the barrel. Therefore, exchange of the watch outer assembly including the barrel is urged. There is a demand for an improvement of this.

In the watch in which the stem pipe has been threaded into the barrel, it is considered in principle that parts located around the crown including the stem pipe can be exchanged. Even in this structure, however, a rotating force acts on the stem pipe whenever the crown is threaded to, or unthreaded from the stem pipe. This produces rotation of the stem pipe, loosening the threaded engagement of the stem pipe into the barrel. The force at which the waterproof packing is sandwiched decreases. Concomitantly, there is the danger that the waterproofness by the waterproof packing drops.

As a countermeasure against this, adhesive may be loaded into the threaded portion between the stem pipe and the barrel. Where adhesive bonding is done in this way, it is difficult to remove the stem pipe from the barrel. Practically, it is impossible to replace parts located around the crown. As a result, where the threadedly locking function deteriorates, it is urged to replace the watch outer assembly including the barrel. Therefore, there is a demand for an improvement of this.

It is an object of the present invention to provide a watch in which the waterproofness will not be impaired by manipulation of the crown and which permits exchange of parts located around the crown in a case where the threadedly locking function has deteriorated.

SUMMARY OF THE INVENTION

To solve the foregoing problem, a watch according to the present invention comprises: a barrel having a pipe installation hole and a threaded hole perpendicularly in communication with the installation hole; a stem pipe having an outer surface provided with an engaging recessed portion, the stem pipe further including an insertion portion inserted in the pipe installation hole so as to be withdrawable from outside of the barrel, the step pipe further including a barrel outside protruding portion disposed outside the barrel and having an external thread; an annular waterproof packing sandwiched between the pipe installation hole and the insertion portion; a mounting screw threaded into the threaded hole so as to be movable back and forth, the mounting screw being inserted in the engaging recessed portion and holding the step pipe to the barrel; and a crown having an inner cylindrical portion inserted inside the insertion portion, the crown further including an internal thread removably threaded to the external thread, the crown further including an outer cylindrical portion bearing against a barrel outer surface of the barrel.

In the present invention, the front-end portion of the mounting screw threaded into the threaded hole in the barrel is engaged in the engaging recessed portion of the stem pipe inserted in the pipe mounting hole in the barrel. The stem pipe is held to the barrel to prevent its movement in the axial direction. This holding is not impaired by manipulation of the crown. Therefore, there is no danger that the waterproofness provided between the barrel and the stem pipe by the waterproof packing sandwiched between the barrel and the stem pipe along a radial direction of the stem pipe not in the direction in which the center axis of the stem pipe extends is impaired by manipulations of the crown. The holding of the stem pipe to the barrel is released by disengaging the mounting screw from the engaging recessed portion, which is done by moving rearwardly the screw that can be moved forward and rearward from outside the barrel. Consequently, the stem pipe can be pulled out from the barrel. Therefore, the threadedly locking function can be exhibited by the engagement between the external thread of the barrel outside protruding portion and the internal thread of the crown. Where the threadedly locking function deteriorates as the crown is rotationally manipulated by releasing the threaded engagement to release the threadedly locking function, the stem pipe or the like can be replaced for the barrel.

In a preferred embodiment of the present invention, the engaging recessed portion is formed as an annular groove extending continuously and without breaks in a circumferential direction of the insertion portion. In this preferred embodiment, the engaging recessed portion can be readily and easily mounted by cutting the outer surface of the insertion portion. This is preferable for manufacturing. Furthermore, when the stem pipe is mounted in the pipe installation hole, it is not necessary to place the insertion portion in position relative to the threaded hole in the circumferential direction. This is also preferable for manufacturing.

Furthermore, in a preferred embodiment of the present invention, the waterproof packing is mounted to the outer surface of the insertion portion. In this preferred embodiment, the waterproof packing is more easily mounted and, during maintenance, is attached and detached more easily than where the waterproof packing is mounted to the inner surface of the pipe installation hole. Also, the pipe installation hole can be machined easily. These are preferable for manufacturing.

In addition, in a preferred embodiment of the present invention, the threaded hole is formed from a rear surface of the barrel to the pipe installation hole. The mounting screw is inserted in the threaded hole from the rear surface of the barrel. In this preferred embodiment, the threaded hole can be made shorter than in the case where a threaded hole is formed from a surface of the barrel to a pipe installation hole. Consequently, the depth to which the threaded hole can be machined and the amount by which the screw is tightened can be reduced with preferable results.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Figure 1:
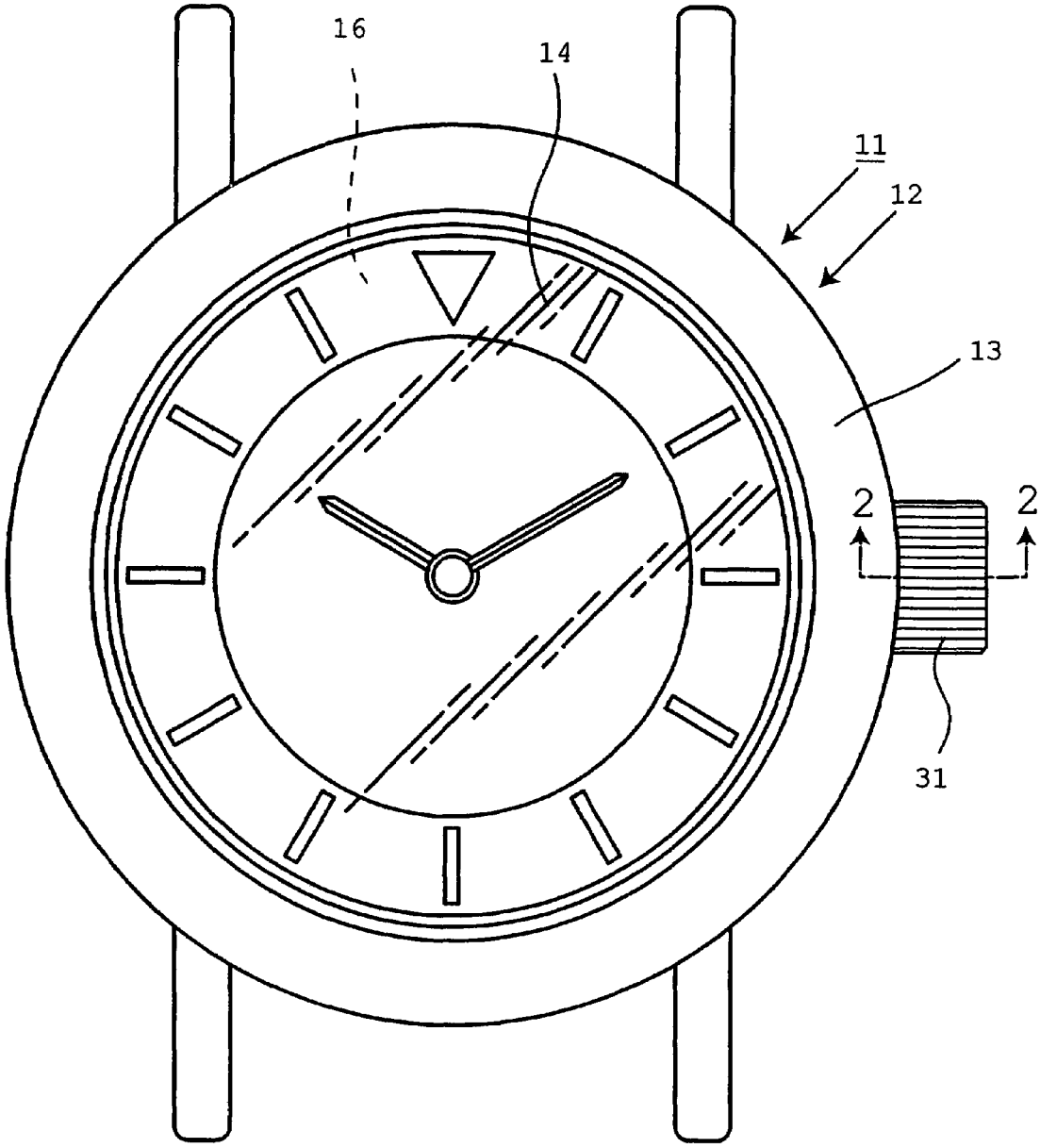
FIG. 1 is a front elevation showing a wristwatch associated with a first embodiment of the present invention.
Figure 2:
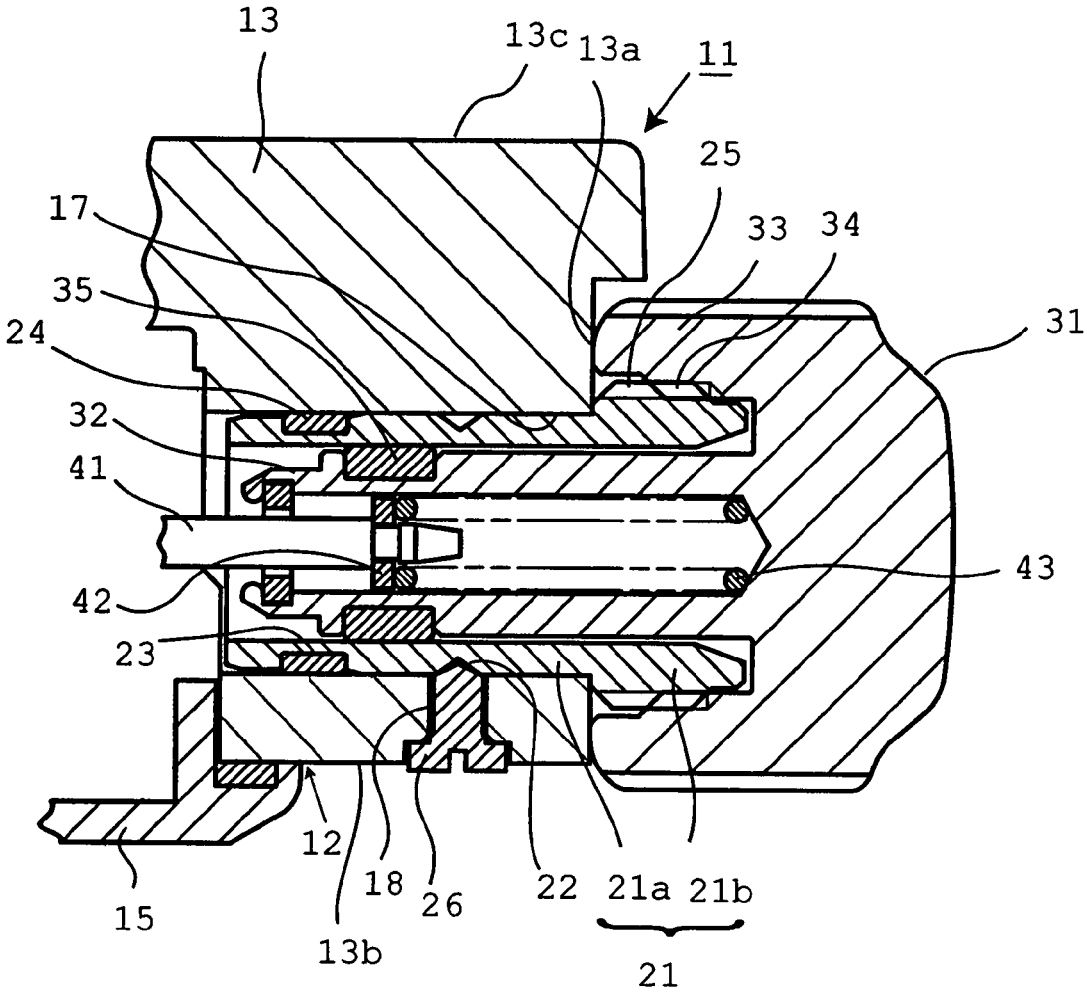
FIG. 2 is a crosssectional view shown along the line 2-2 through FIG. 1 in a state in which the crown has been threadedly locked.
Figure 3:
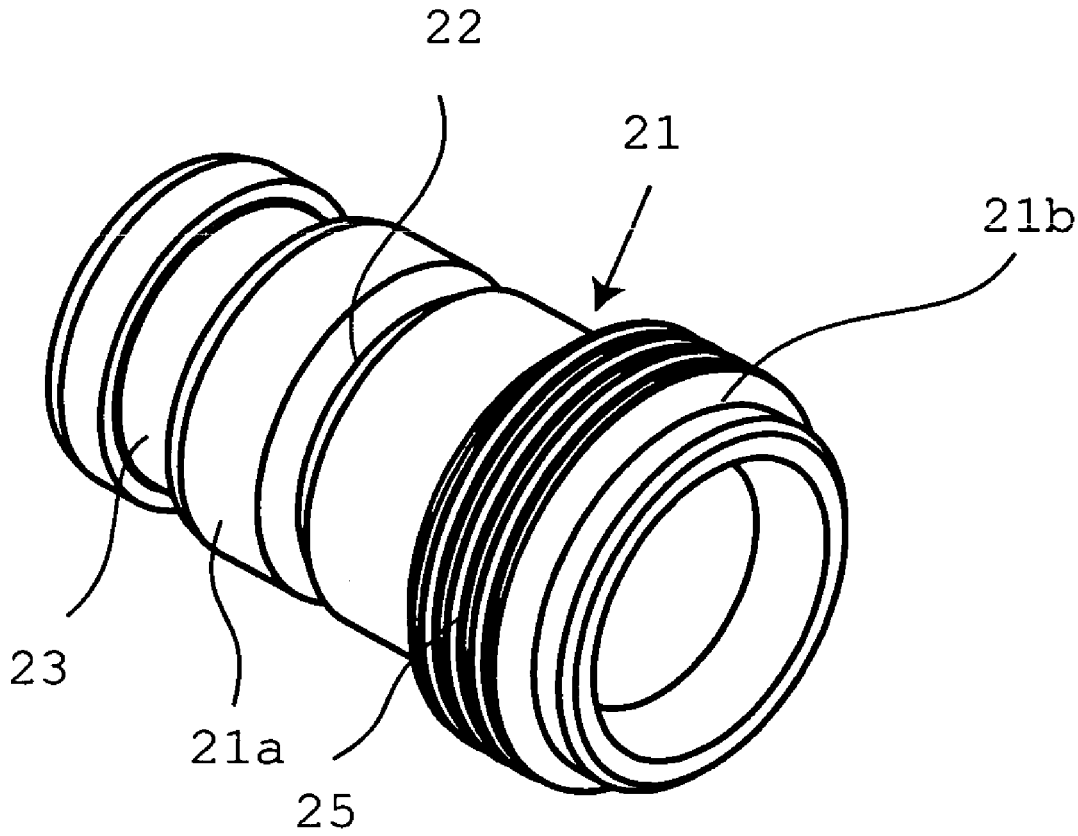
FIG. 3 is a perspective view showing the stem pipe of a wristwatch associated with the first embodiment.

A first embodiment of the present invention is described by referring to FIGS. 1-3.

In FIG. 1, symbol 11 indicates a watch equipped with a function of threadedly locking the crown such as a wristwatch. The wristwatch 11 incorporates a watch movement (not shown) or the like in a watch outer assembly 12. The watch movement may be any one of a movement powered by a small-sized battery or spring, an automatically wound movement, a movement corresponding to a digital watch that digitally displays the time and so forth on a dial by a quartz oscillation module, a movement corresponding to a digital watch, and a combination with others.

The watch outer assembly 12 has an annular barrel 13 made of a metal such as stainless steel or titanium or synthetic resin. A cover glass 14 is mounted to the whole surface of the barrel in the direction of thickness in a liquid tight manner. A rear cover 15 (see FIG. 2) made of a metal or the like is mounted to the rear surface of the barrel 13 in the direction of thickness in a liquid tight manner. It is possible to see through the dial 16 and so on via the cover glass 14. The rear cover 15 can be removed.

As shown in FIG. 2, the barrel 13 is provided with a pipe installation hole 17 extending radially through this barrel 13. One end of the pipe installation hole 17 opens into the barrel, i.e., into the watch outer assembly 12. The other end of the pipe installation hole 17 opens into the outside of the barrel, i.e., outside of the watch outer assembly 12. To have a good hole machinability of the pipe installation hole 17, the hole is made of a straight hole having no step. However, it may have a step. In FIG. 2, symbols 13*a*, 13*b*, and 13*c* indicate the barrel outer surface, the rear surface of the barrel, and the surface of the barrel, respectively.

The barrel 13 is provided with a threaded hole 18 which is located closer to the barrel outer surface 13*a* (in other words, located between the bisector point of the pipe installation hole 17 in the longitudinal direction and the barrel outer surface 13*a*) and which extends in the direction of the thickness of the barrel 13. The threaded hole 18 is formed between the rear surface 13*b* of the barrel 13 and the pipe installation hole 17 and extends perpendicularly to and in communication with the pipe installation hole 17. Here, "perpendicularly" includes angular error of several degrees due to variations in the accuracy at which the hole is machined. Note that the threaded hole 18 may be formed so as to extend from the surface 13*c* of the barrel 13 to the pipe installation hole 17.

A stem pipe 21 is mounted to the barrel 13 so as to be capable of being pulled out of the barrel. That is, a stem pipe 21 made of a metal (e.g., stainless steel or the like) has an insertion portion 21*a* at one end side and a barrel outside protruding portion 21*b* at the other end side as shown in FIGS. 2 and 3. The insertion portion 21*a* is shaped like a straight pipe having an outside diameter substantially equal to the diameter of the pipe installation hole 17. An engaging recessed portion 22 and a packing groove 23 are formed in its outer surface. The insertion portion 21*a* may have a sufficient length to extend through the pipe installation hole 17.

The engaging recessed portion 22 is formed annularly continuously and without breaks in the circumferential direction of the insertion portion 21*a* in a position closer to the barrel outside protruding portion 21*b*than the front end of the insertion portion 21*a*. This engaging recessed portion 22 consists of a V-shaped annular groove.

The packing groove 23 is formed annularly continuously and without breaks in the circumferential direction of the insertion portion 21*a* in a position closer to the front end of the insertion portion 21*a*than the engaging recessed portion 22. Annular waterproof packing 24 is fitted in this packing groove 23. The waterproof packing 24 is made of a packing material capable of resiliently deforming. Its outside diameter is larger than the maximum outside diameter of the insertion portion 21*a* and slightly larger than the diameter of the pipe installation hole 17 in an unloaded state.

The barrel outside protruding portion 21*b* is a portion located outside the barrel 13 and is larger in diameter than the insertion portion 21*a*. An external thread 25 is formed on the outer surface of the barrel outside protruding portion 21*b*.

The insertion portion 21*a* of the stem pipe 21 is inserted in the pipe installation hole 17 so as to be capable of being pulled out from the outside of the barrel. The appropriate depth of the insertion is restricted by the step formed between the insertion portion 21*a* and the barrel outside protruding portion 21*b*, i.e., by abutment of the end surface of the barrel outside protruding portion 21*b* closer to the insertion portion 21*a* against the barrel outer surface 13*a*. Because of this positional restriction, the engaging recessed portion 22 is placed in position in the threaded hole 18 Furthermore, as the insertion portion 21*a* is inserted into the pipe installation hole 17, the waterproof packing 24 is resiliently deformed into a compressed state and sandwiched between the insertion portion 21*a* and the pipe installation hole 17. This brings the waterproof packing 24 into intimate contact with the inner surface of the pipe installation hole 17, providing waterproofness between the barrel 13 and the stem pipe 21.

A mounting screw 26 is threaded into the threaded hole 18 from the rear side of the barrel 13 so as to be movable back and forth. The mounting screw 26 is made of a metal (e.g., a metal of the same kind as the barrel 13). Its front-end portion forms a tapering V-shaped form. The angle of the V-shaped form of the front-end portion is larger than the angle of a V-groove forming the engaging recessed portion 22. This prevents slack in the engagement between the engaging recessed portion 22 and the mounting screw 26. By screwing the mounting screw 26 into it, the front-end portion is inserted into the engaging recessed portion 22 and caught in the insertion portion 21*a*. This holds the stem pipe 21 to the barrel 13, thus preventing disengagement. By loosening the threaded insertion of the mounting screw 26, the front-end portion can be disengaged from the engaging recessed portion 22 such that the stem pipe 21 can be pulled out of the barrel 13.

A crown indicated by symbol 31 in FIGS. 1 and 2 is made of a metal material such as stainless steel, titanium, or the like, and has an inner cylindrical portion 32 and an outer cylindrical portion 33 integral with it. The inner cylindrical portion 32 is a portion inserted into the stem pipe 21. The outer cylindrical portion 33 is shorter than the inner cylindrical portion 32. A threadedly locked internal thread 34 is formed on its inner surface. Unevenness is formed on the outer surface of the outer cylindrical portion 33 to prevent the user's finger from slipping during manipulation of the crown.

The inner cylindrical portion 32 of the crown 31 is inserted inside the stem pipe 21 so as to be movable back and forth in the axial direction. Annular waterproof packing 35 is mounted in an annular groove formed in the outer surface of the inner cylindrical portion 32. The waterproof packing 35 is resiliently deformed into a compressed state and sandwiched between the inner surface of the stem pipe 21 and the outer surface of the inner cylindrical portion 32, providing waterproofness between them.

The internal thread 34 of the crown 31 is removably threaded to the external thread 25 of the stem pipe 21. The internal thread 34 can be more deeply threaded into the external thread 25 by putting a finger on the outer cylindrical portion 33 of the crown 31 and rotating the crown 31 in the direction to tighten it (in the direction of threaded insertion). Conversely, the threaded engagement can be released by rotating the crown 31 in the direction to loosen it. The end surface of the outer cylindrical portion 33 is brought into contact with the barrel outer surface 13*a* of the barrel 13 as shown in FIG. 2 by rotating the crown 31 to tighten it. Thus, the threadedly locking function is exhibited to prevent inadvertent rotation of the crown 31 during carriage of the wristwatch 11.

As shown in FIG. 2, the stem 41 of the watch movement is inserted in the inner cylindrical portion 32 from inside the barrel 13 toward the outside. A biasing body such as a coil spring 43 for biasing the crown 31 outwardly of the barrel 13 via a spring receiver 42 while supported by the stem 41 is also accommodated. The watch movement is rotated interlockingly with rotational manipulations of the crown 31 under the condition where the internal thread 34 has been disengaged from the external thread 25 (in other words, the threadedly locking has been released). Consequently, the watch can be set.

After manipulation of the crown, the crown 31 is mounted to the stem pipe 21 and threadedly locked. For this purpose, the crown 31 is rotated while the stem 41 is kept connected with the inner cylindrical portion 32 of the crown 31. The internal thread 34 is threaded to the external thread 25 of the stem pipe 21 and tightened. If the crown 31 is threaded into the external thread 25 most deeply, the outer cylindrical portion 33 is abutted against the barrel outer surface 13*a*. The threadedly locking function is exhibited. Under this condition, the crown 31 covers and hides the barrel outside protruding portion 21*b* of the stem pipe 21.

When the wristwatch 11 is being carried under this condition, the crown 31 is threadedly locked as described above. Therefore, the displayed time can be prevented from varying due to inadvertent rotation of the crown 31. When the watch is set, the crown 31 is rotated in the direction opposite to the direction used when threadedly locking is done, disengaging the internal thread 34 from the external thread 25. The crown 31 is pulled out against the spring force of the coil spring 43. Under this condition, the setting can be done.

As the crown is manipulated as described so far, if the engaging portions of the internal thread 34 of the crown 31 and the external thread 25 of the stem pipe 21 are damaged, vicinities of the crown, i.e., the stem pipe 21 fitted with the waterproof packing 24 and the crown 31 fitted with the waterproof packing 35, can be exchanged in the procedure described in the following.

First, the crown 31 and the stem pipe 21 are disengaged. Then, the rear cover 15 is removed, and the stem 41 and the crown 31 are brought to a state in which they are disconnected. Then, the mounting screw 26 is rotated in the direction to loosen it, retracting the screw 26. The stem pipe 21 is unlocked. Under this condition, the stem pipe 21 is pulled out of the barrel 13.

Then, new waterproof packing 24 is mounted. The insertion portion 21*a* of a prepared, new stem pipe 21 is inserted into the pipe installation hole 17 in the barrel 13 from outside the barrel 13. This insertion is done until the barrel outside protruding portion 21*b* of the new stem pipe 21 strikes the barrel outer surface 13*a* of the barrel 13. This positional restriction places the engaging recessed portion 22 of the new stem pipe 21 and threaded hole 18 in opposition to each other appropriately and in communication with each other. Under this condition, the mounting screw 26 threaded to the barrel 13 is rotated in the direction to tighten the screw. The front-end portion of the mounting screw 26 is inserted and engaged in the engaging recessed portion 22 of the new stem pipe 21 inserted in the barrel 13. In this way, the new stem pipe 21 is held to the barrel 13, thus preventing disengagement of the pipe.

Thereafter, new waterproof packing 35 is mounted. The inner cylindrical portion 32 of a prepared, new crown 31 is inserted into the stem pipe 21. Then, this new crown 31 and the crown stem 41 are connected. Then, the rear cover 15 is closed. Then, the new crown 31 is rotated in the direction to tighten it. The internal thread 34 is threaded to the external thread 25 of the stem pipe 21. Thus, the outer cylindrical portion 33 of the new crown 31 abuts against the barrel outer surface 13*a*, creating a threadedly locked state.

Where the threadedly engaging portions of the stem pipe 21 and the crown 31 become damaged by the procedure described so far, only parts located around the crown can be replaced without the need to replace the watch outer assembly 12. Therefore, vicinities of the crown can be repaired with less cost burden for the user. The waterproof packing 24 sandwiched between the barrel 13 and the stem pipe 21 in a compressed state and the waterproof packing 35 sandwiched between the stem pipe 21 and the crown 31 effectively waterproof the vicinities of the crown in the repaired wristwatch 11.

As the crown is manipulated, the stem pipe 21 is rotated relative to the barrel 13. This may vary the relative position between the waterproof packing 24 and the barrel 13. However, the waterproof packing 24 is narrowed down along a radial direction. Therefore, even when the relative position varies, the waterproof packing 24 is prevented from loosening and therefore, the waterproof performance is not deteriorated. Therefore, desired waterproof performance can be anticipated reliably.

Furthermore, in the wristwatch 11 of the above-described structure, the engaging recessed portion 22 of the stem pipe 21 is formed of an annular groove and so during assembly, the engaging recessed portion 22 and the threaded hole 18 of the barrel 13 can be placed in position reliably by a simple labor consisting of inserting the insertion portion 21*a* of the stem pipe 21 into the pipe installation hole 17 until the barrel outside protruding portion 21*b* strikes the barrel outer surface 13*a* irrespective of the sense of the stem pipe 21 relative to the barrel 13 in the peripheral direction.

Furthermore, the engaging recessed portion 22 consisting of an annular groove can be formed by pushing a cutting tool against a desired portion while rotating the stem pipe 21, in the same way as in the case where the insertion portion 21*a* of the stem pipe 21 is cut. Therefore, it is easy to form the engaging recessed portion 22. This is preferable for machining. In addition, even during machining for forming the threaded hole 18 in the barrel 13, the threaded hole 18 is short in length because the threaded hole 18 is formed from the rear surface 13*b* of the barrel 13. Concomitantly, the depth of the hole in the barrel 13 is small. This is desirable for machining. Moreover, the waterproof packing 24 is mounted on the outer surface of the insertion portion 21*a* of the stem pipe 21 instead of in the pipe installation hole 17. Therefore, the engaging recessed portion 22 can be formed more easily by pushing a cutting tool against a desired portion on the outer surface of the insertion portion 21*a* compared with the case where an annular groove for mounting the waterproof packing 24 is formed in the pipe installation hole 17. This is desirable for machining. Because of these, the machining cost can be reduced.

Additionally, a standardized product can be used as the mounting screw 26. Any screw of a special configuration is not required. Concomitantly, any dedicated tool for removing the stem pipe 21 is not necessary.

Figure 4:
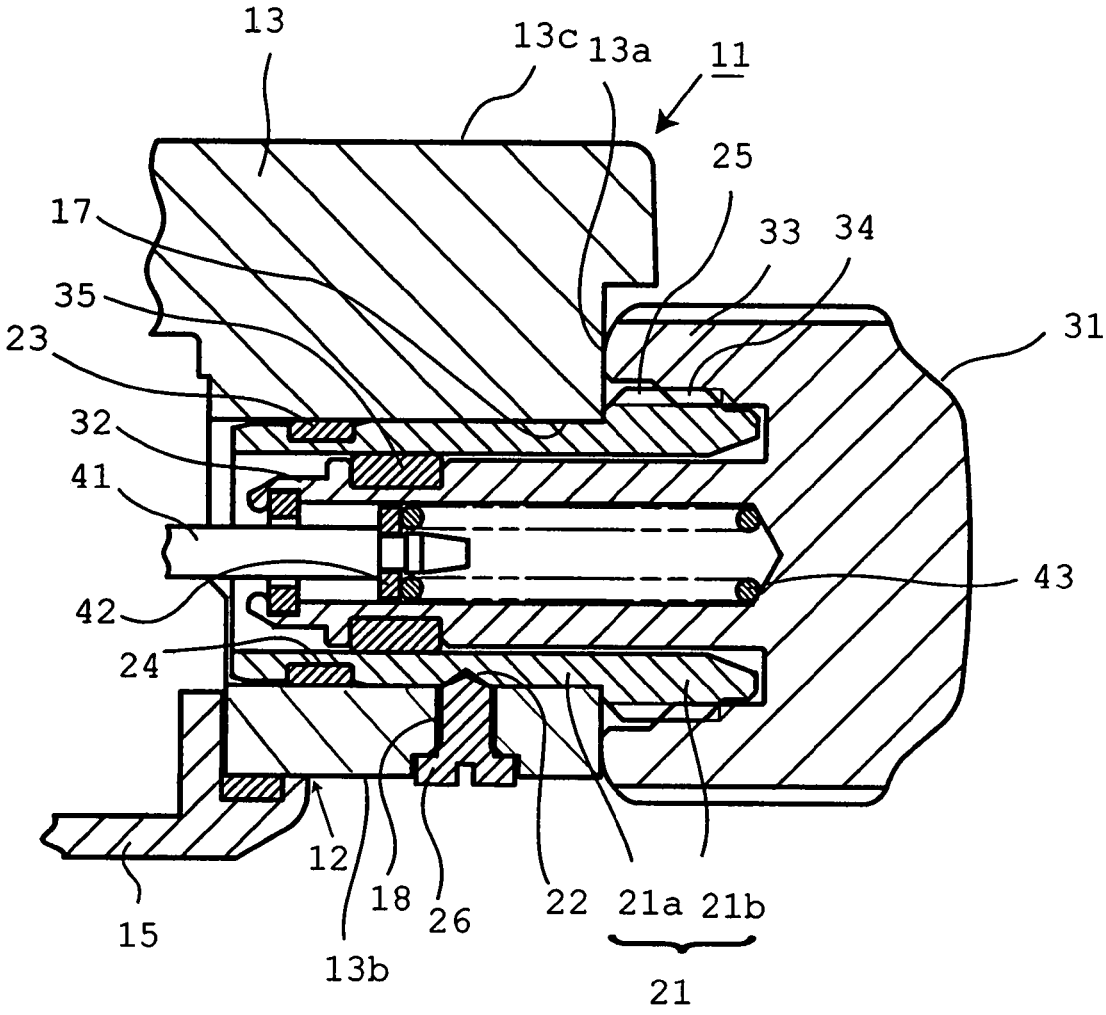
FIG. 4 is a-cross-sectional view corresponding to FIG. 2, showing vicinities of the crown of a wristwatch associated with a second embodiment of the present invention.
Figure 5:
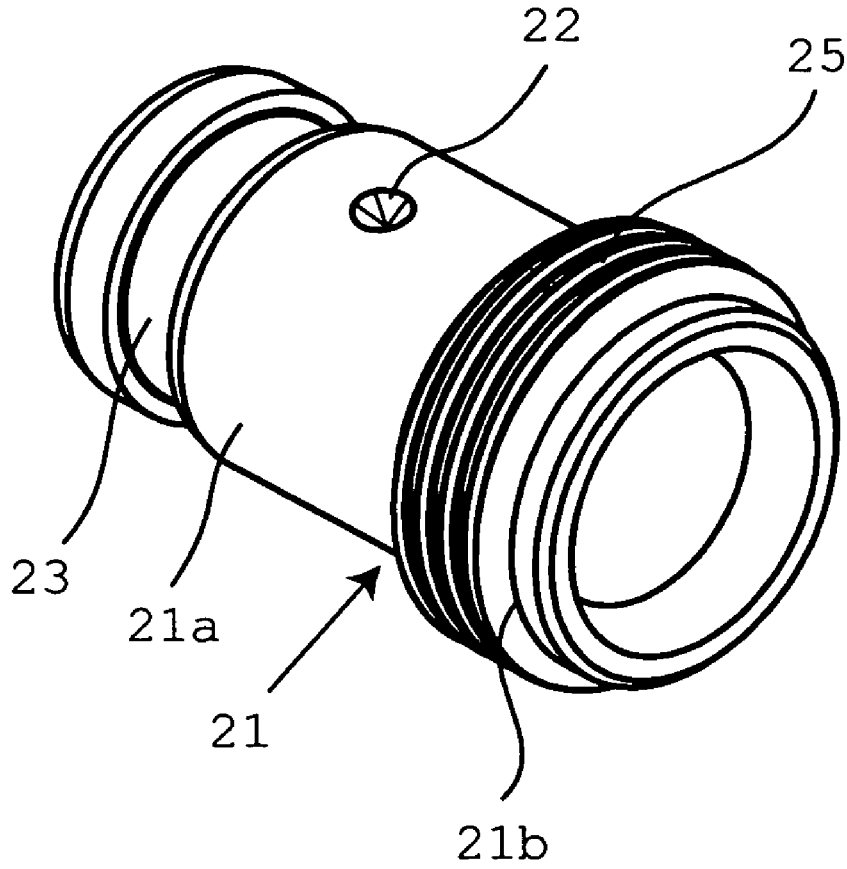
FIG. 5 is a perspective view showing the stem pipe of a wristwatch associated with the second embodiment.

FIGS. 4 and 5 show a second embodiment of the present invention. Since the second embodiment is essentially identical with the first embodiment, those portions of the second embodiment which are identical or similar in structure or function with the corresponding portions of the first embodiment are indicated by the same symbols as in the first embodiment and their description is omitted. The points which are different from the first embodiment are described in the following.

In the second embodiment, the engaging recessed portion 22 in the outer surface of the insertion portion 21*a* is formed by a small hole as shown in FIG. 5 instead of an annular groove. This small hole (engaging recessed portion 22) is formed by pushing a drill against the insertion portion from a direction perpendicular to the center axis of the insertion portion 21*a*. The cross section of the hole assumes a V-shaped form as shown in FIG. 4. Furthermore, in this embodiment, alignment marks are preferably provided on the end surfaces of the barrel outer surface 13*a* and barrel outside protruding portion 21*b* for positional alignment between the engaging recessed portion 22 and the threaded hole 18. In this case, the alignment mark on the barrel outer surface 13*a* should be provided in a given positional relationship with the threaded hole 18. The alignment mark on the stem pipe 21 should be provided on the engaging recessed portion 22 in the same relationship as that positional relationship. The second embodiment is identical with the first embodiment except for the items described so far.

Accordingly, in the second embodiment, too, the same advantages as those of the first embodiment are obtained. The problem that the present invention tackles can be solved. Furthermore, in the second embodiment, the mounting screw 26 is engaged in the engaging recessed portion 22. This can prevent the stem pipe 21 from coming off the barrel 13. In addition, as the crown is manipulated, the stem pipe 21 can be prevented from rotating relatively to the barrel 13.

Figure 6:
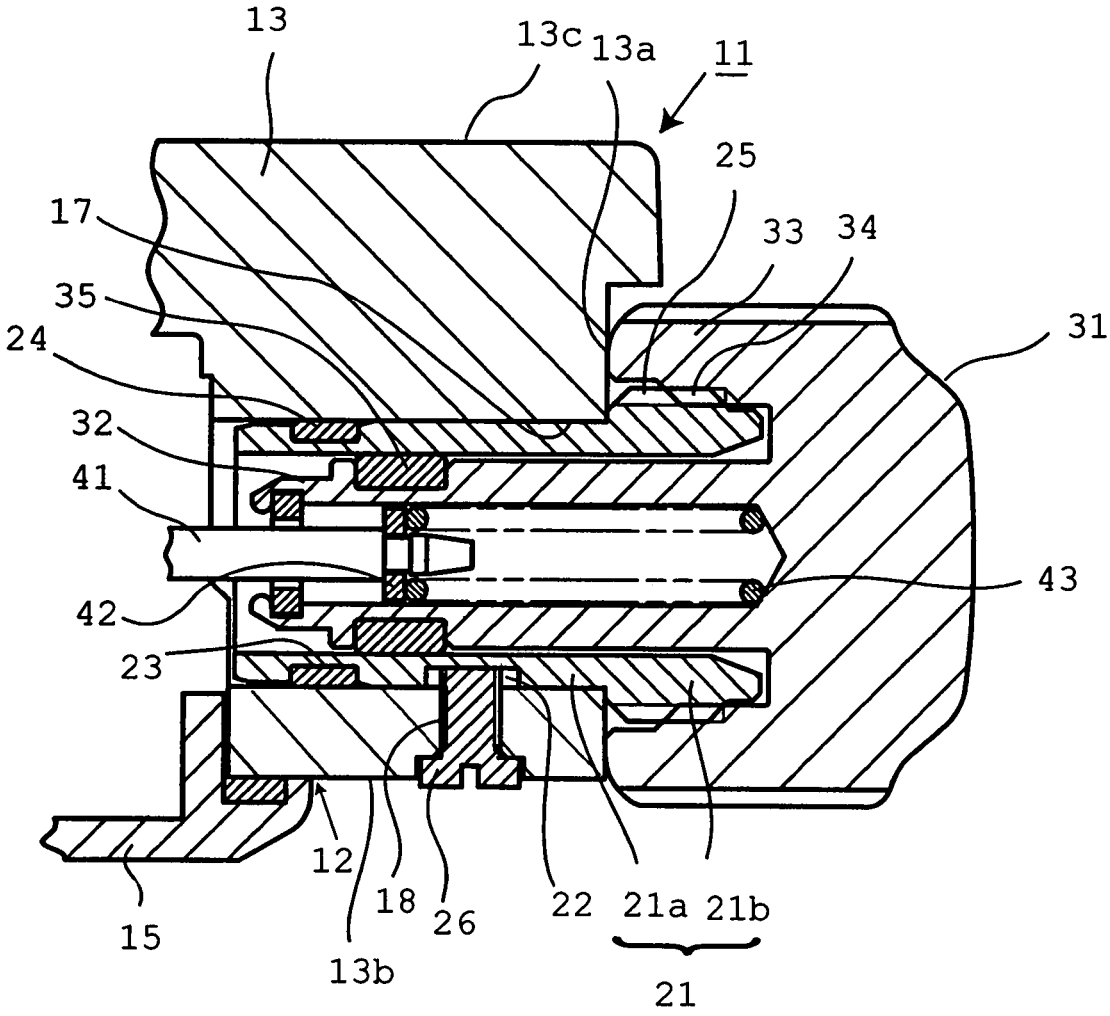
FIG. 6 is a cross-sectional view corresponding to FIG. 2, showing vicinities of the crown of a wristwatch associated with a third embodiment of the present invention.
Figure 7:
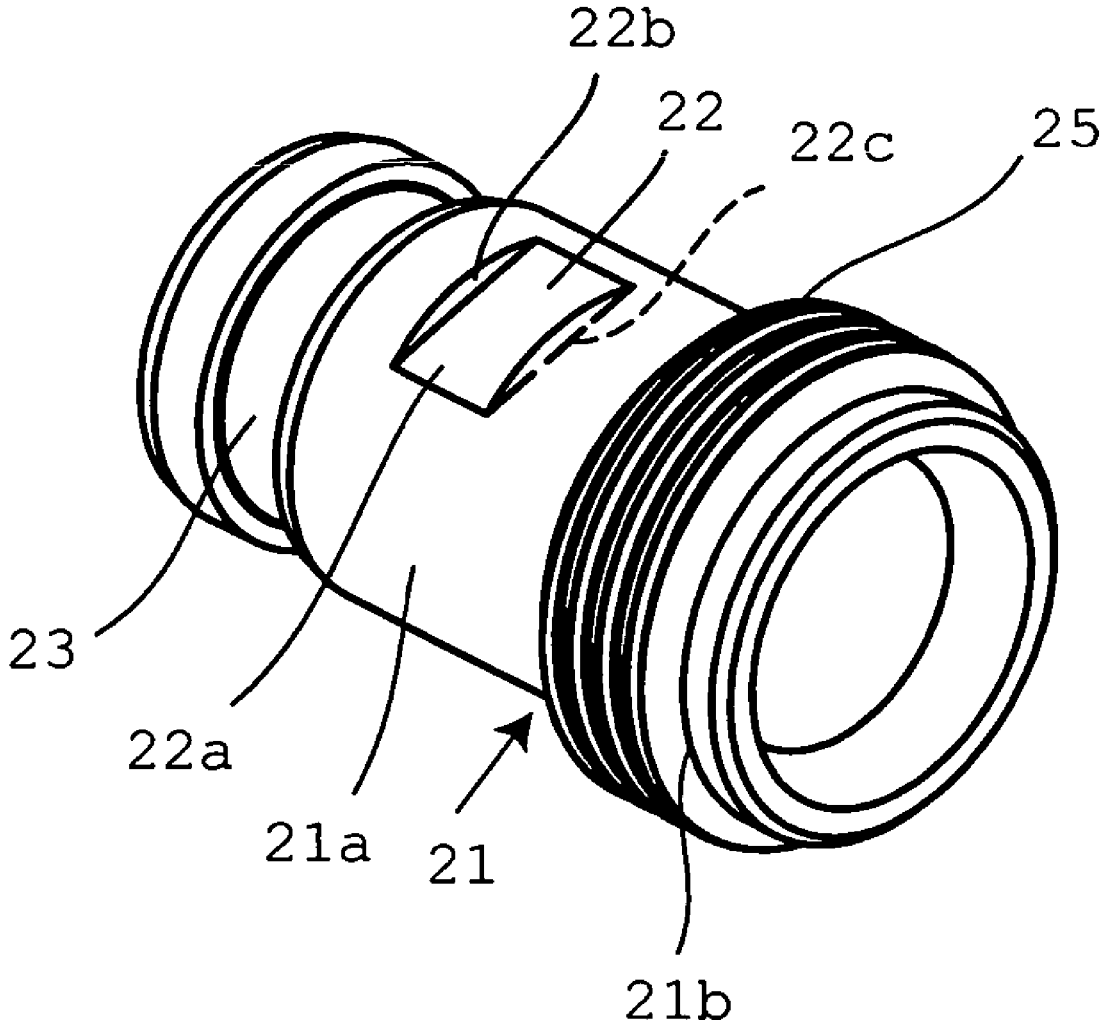
FIG. 7 is a perspective view showing the stem pipe of a wristwatch associated with the third embodiment.

FIGS. 6 and 7 show a third embodiment of the present invention. Since the third embodiment is essentially identical with the first embodiment, those portions of the third embodiment which are identical or similar in structure or function with the corresponding portions of the first embodiment are indicated by the same symbols as in the first embodiment and their description is omitted. The points which are different from the first embodiment are described in the following.

In the third embodiment, the engaging recessed portion 22 in the outer surface of the insertion portion 21*a* is formed by a cutout-like groove formed by removing a part of the outer surface of the insertion portion 21*a* as shown in FIG. 7, instead of an annular groove. This engaging recessed portion 22 has a flat bottom surface 22*a*. This engaging recessed portion 22 has been machined by passing a milling cutter through the outer surface of the insertion portion 21*a* from a direction perpendicular to the direction in which the center axis of the insertion portion 21*a* extends.

Furthermore, as shown in FIG. 6, a screw having a flattened front-end surface (flat surface perpendicular to the axis of the screw) is used as the mounting screw 26. As shown in FIG. 6, rotation of the stem pipe 21 relative to the barrel 13 is prevented as the crown is manipulated, by pushing the flat front-end surface of the mounting screw 26 against the flat bottom surface 22*a* of the engaging recessed portion 22. Furthermore, axial movement of the stem pipe 21 is hindered by engagement of side surfaces 22*b* and 22*c* extending continuously perpendicularly to both sides of the bottom surface 22*a* with the front-end portion of the mounting screw 26. The third embodiment is identical with the first embodiment except for the items described so far.

Accordingly, in the third embodiment, too, the same advantages as those of the first embodiment are obtained. The problem that the present invention tackles can be solved. In addition, the stem pipe 21 can be held to the barrel 13 by the mounting screw 26 by tightening the mounting screw 26 such that the stem pipe 21 does not come off the barrel in the axial direction. Also, corotation of the stem pipe 21 due to manipulation of the crown can be prevented with preferable results. Furthermore, the engaging recessed portion 22 is made to extend some length in the peripheral direction of the insertion portion 21*a*. Therefore, as long as the engaging recessed portion 22 and the threaded hole 18 are opposite to each other, the stem pipe 21 can be rotated as the mounting screw 26 is tightened even if they are not correctly in opposition. Consequently, a correct state of mounting is obtained in which the bottom surface 22*a* of the engaging recessed portion 22 and the front-end surface of the mounting screw 26 are in surface contact with each other. In consequence, the assembly is easy to perform with preferable results.

The present invention is not limited to the above-described embodiments. The invention can also be applied to wristwatches required to have high-pressure waterproof performance such as divers watches. In addition, the invention can also be applied to watches not required to have such high-pressure waterproof performance such as normal wristwatches, pocket watches, and necklace hanging watches.

According to the present invention, a watch can be provided in which there is no danger that the waterproofness is impaired by manipulations of the crown. Also, where the threadedly locking function deteriorates, parts located around the crown can be replaced without involving the barrel.

What is claimed is:

1. A watch comprising:

a barrel having a pipe installation hole and a threaded hole perpendicular to and in communication with the installation hole;

a stem pipe having an outer surface provided with an engaging recessed portion, the stem pipe including an insertion portion inserted in said pipe installation hole so as to be withdrawable from outside of said barrel, the stem pipe further including a barrel outside protruding portion disposed outside said barrel and having an external thread;

an annular waterproof packing sandwiched between said pipe installation hole and said insertion portion;

a mounting screw threaded into said threaded hole so as to be movable back and forth, the mounting screw being inserted in said engaging recessed portion to hold said stem pipe to said barrel; and a crown having an inner cylindrical portion inserted inside said insertion portion, said crown including an internal thread removably threaded to said external thread, the crown further including an outer cylindrical portion bearing against a barrel outer surface of said barrel.

2. A watch according to claim 1; wherein said engaging recessed portion is formed as an annular groove extending continuously and without breaks in a circumferential direction of said insertion portion.

3. A watch according to claim 1; wherein said waterproof packing is mounted to the outer surface of said insertion portion.

4. A watch according to claim 1; wherein said threaded hole extends from a rear surface of said barrel to said pipe installation hole, and wherein said mounting screw is inserted in said threaded hole from the rear surface of said barrel.

* * * * *